US006690144B1

(12) United States Patent
DeNicholas et al.

(10) Patent No.: US 6,690,144 B1
(45) Date of Patent: Feb. 10, 2004

(54) OPEN LOOP INDUCTOR CURRENT CONTROL SYSTEM AND METHOD

(75) Inventors: Joseph DeNicholas, Chandler, AZ (US); Randall C Gray, Tempe, AZ (US)

(73) Assignee: Motorola, Inc., Schaumburg, IL (US)

( * ) Notice: Subject to any disclaimer, the term of this patent is extended or adjusted under 35 U.S.C. 154(b) by 0 days.

(21) Appl. No.: 10/215,582

(22) Filed: Aug. 9, 2002

(51) Int. Cl.[7] ..... G05F 1/10; G05F 1/656
(52) U.S. Cl. ..... 323/222; 323/223; 323/299
(58) Field of Search ..... 323/222, 299, 323/223, 282

(56) References Cited

U.S. PATENT DOCUMENTS 4,347,474 A * 8/1982 Brooks et al. ..... 323/224
4,761,725 A * 8/1988 Henze ..... 363/46
4,929,882 A * 5/1990 Szepesi ..... 323/222
4,975,819 A * 12/1990 Lannuzel ..... 363/16
5,350,997 A * 9/1994 Ghotbi et al. ..... 323/268
5,367,247 A * 11/1994 Blocher et al. ..... 323/222
5,444,358 A * 8/1995 Delepaut ..... 323/222
5,696,439 A * 12/1997 Presti et al. ..... 323/283
5,982,156 A * 11/1999 Weimer et al. ..... 323/222
6,194,880 B1 * 2/2001 Fraidlin et al. ..... 323/222
6,194,882 B1 * 2/2001 Mirow et al. ..... 323/282
6,577,078 B2 * 6/2003 Shen ..... 315/307

* cited by examiner

*Primary Examiner*—Bao Q. Vu
(74) *Attorney, Agent, or Firm*—Steptoe & Johnson, LLP; Tyson York Winarski

(57) ABSTRACT

An open loop current control system for regulating the flow of electrical current in an inductor that utilizes two methods of monitoring the current flow in the inductor. The open loop control system maintains the level of current in the inductor between two boundary levels by switching a boost transistor between an on and an off position based upon the level of current in the inductor. The control system measures the level of current in the inductor when a boost transistor is turned on. When the boost transistor is turned off, the control system determines the time period that is required for the current in the inductor to decay from the upper boundary level to the lower boundary level based upon the measured voltage difference across the inductor.

22 Claims, 3 Drawing Sheets

OPEN LOOP INDUCTOR CURRENT CONTROL SYSTEM AND METHOD

TECHNICAL FIELD OF THE INVENTION

The present invention relates to the field of devices that monitor and regulate the flow of electrical current in an inductive element.

BACKGROUND OF THE INVENTION

Inductor coils are an important component in modern microelectronics. Through applying a voltage difference across an inductor, it is possible to utilize the inductor as a current source. One application of inductor current sources is to charge a capacitor for a reserve power source.

Numerous applications require a backup or reserve power source. A reduction or loss in power from a power supply can hinder or cripple the operation of an electrical system. For example, automotive airbag systems are deployed using an electrical system. These airbag systems are powered from the car charging system. However, during a car accident, the electrical system that triggers the deployment of the air bag may become disconnected from the car charging system. Alternatively, the car accident could damage the car battery or car electrical system causing a reduction in power supplied to the air bag electrical control system. Consequently, this loss or reduction in power could prevent the successful deployment of the airbag causing serious injury or death to the person in the car. However, it is possible to compensate for this loss in power through providing a backup power reserve to the integrated circuit that controls the deployment of the airbag.

The electrical control system that regulates the deployment of the airbag is typically contained within an integrated circuit. The reserve power supply for this system is provided by a boost-switching regulator. The boost-switching regulator provides a reserve source of power in a charged storage capacitor. The capacitor is charged with current from an inductor current source. In the event of a power loss from the primary power supply, this charged capacitor serves as the reserve power source. Ideally, a charged capacitor will hold its stored charge indefinitely. However, actual capacitors lose their stored charge due to current leakage. Therefore, it is necessary to replenish the amount of stored charge in the capacitor. The capacitor is recharged with current from the inductor current source. A transistor such as a MOSFET and a diode serves as a switch between the inductor and the capacitor to turn the flow of current ON and OFF. The design question then becomes when to turn the switching transistor ON and OFF in order to maintain a desired level of charge on the capacitor.

To maintain the level of charge on the capacitor, it is necessary to have a control system that regulates the flow of current through the inductor current source. In addition, it is necessary to regulate the amount of current flowing through the inductor coil for a variety of other reasons. First, inductors have a limited capacity to handle electrical current. Too much electrical current can damage the inductor. Also, the amount of current in the inductor needs to remain at a level that is compatible with the integrated circuit. Too much electrical current can overheat and damage the integrated circuit. Further, the operation of the inductor is optimized through maintaining the level of current in the inductor at a constant average level. In addition, the recharging operation of the capacitor is optimized through providing a constant average current level from the inductor coil.

There are parameters that restrict the design of the control system that regulates the flow of current in the inductor. The integrated circuits that operate these applications like automotive airbags are pin limited. It is therefore necessary to develop an inductor current control system that has a minimal amount of circuitry and uses a small number of integrated circuit pins.

At present, there are a variety of circuit systems known to the art that provide a method of regulating electrical current in inductors. One known system that regulates the flow of current in the inductor employs sense resistors and amplifiers to actually measure the current flowing through the inductor during all phases of transistor operation. This actual measurement of current through the inductor during all phases of transistor operation has the unwanted consequence of consuming additional power.

Many inductor current control systems have a diode placed between the inductor and the storage capacitor to prevent reverse current flow from the capacitor. One inductor control system known to the art integrates this diode into the integrated circuit. This integration of the diode is undesirable for several reasons. First, it is necessary to optimize the diode for losses. The forward voltage drop and the switching losses of the diode compound the electrical losses of the system. Consequently, a fast switching low forward voltage drop diode is required. Typically, Schottkey diodes are implemented to meet these specifications. However, the majority of BiCMOS processes do not allow for the fabrication of such structures on an integrated circuit. Secondly, integrating the diode into the integrated circuit increases the power dissipation of the integrated circuit. Finally, the diode must also have favorable current blocking capabilities for high voltage applications. As such, this integrated diode must usually have the form of a pnp structure. However, the pnp structure has the disadvantage of driving current into the substrate causing operating problems for the integrated circuit.

Another inductor current control system known to the art forces the current in the inductor to zero. The system then measures the amount of time necessary to achieve a maximum current level. This time measurement yields input voltage information that is used to determine the amount of time necessary to charge the storage capacitor with inductor current. While this system does regulate the flow of current in an inductor, its operation has several disadvantages. First, the swing of the current from a zero value to a maximum value is not optimal. In order to achieve a desired average level of current, it is necessary to create a maximum current level twice the amount of the desired average current level. Consequently, to handle this large maximum current, it is necessary to use a large inductor. The current flowing into the capacitor is switched ON and OFF through the use of a MOSFET and a diode. Having a large amount of maximum current flowing through a large inductor consequently requires a large MOSFET and a diode to switch the current. These large devices consume significant amounts of power and reduce the efficiency of the overall electrical control system.

One other inductor current control system known to the art operates based upon measuring the terminal voltages at the inductor coil. This voltage measurement yields current information in the inductor. While this system functions, it has the disadvantage of requiring a large storage capacitor having a value of several micro-Farads. In practice, it is not feasible to integrate such a large capacitor into a control system based on a single integrated circuit. Consequently, it is necessary to utilize an external pin to integrate the capacitor into the system.

In view the high power and lifetime demands of modem applications, it is therefore highly desirable to develop a new inductor current control system with improved power usage and component characteristics.

SUMMARY OF THE INVENTION

The present invention is an open loop current control system for regulating the flow of electrical current in an inductor. The present invention functions to maintain the level of electrical current between an upper and a lower boundary level. The amount of current flowing through the inductor is controlled through the switching of a transistor. The switching of the transistor between an ON and an OFF position keeps the level of inductor current within the upper and lower boundary levels.

The switching of the transistor between the ON and OFF positions is based upon the amount of current that flows within the inductor. The present invention uses two separate methods to determine whether the transistor should be in an ON or an OFF position based upon the amount of inductor current flow. When the transistor is in an ON position, the current in the inductor is actually measured by the control system. The duration that the transistor remains on is determined directly from the actual amount of current flow measured by the system.

The control system uses a different method to control the duration that the transistor remains in an OFF position. The system externally reproduces the current changes in the system utilizing a timing circuit. In the OFF state, the system measures the voltage difference across the inductor, which has a known inductance. From this measurement, the rate of change in the current within the inductor is known. The timing circuit uses this rate of change information to mark the period of time that it takes the current within the inductor to decrease from the upper boundary level to the lower boundary level.

Through maintaining the level of current within the inductor to an amount between the upper and lower boundaries, the current flowing through the inductor is optimized. In addition, the frequency characteristics of the system are improved by maintaining the inductor current within the upper and lower boundary levels.

This inductor current control system has numerous applications. For instance, this control system is useful for maintaining a level of charge stored on a capacitor as a part of a reserve power system. Alternatively, it is possible to regulate the flow of current in an induction motor using this inductor control system. Further, this inductor current control system is useful for operating the inductor as a controlled current source.

Through determining the amount of current without actually measuring the amount of current while the transistor is off, the present invention reduces the amount of power consumed by the open loop inductor current control system. This reduction in power increases the efficiency of the device. Further, through measuring the voltage across the inductor, the circuit of the present invention is relatively simple and requires a minimal amount of pins to implement.

DETAILED DESCRIPTION OF A PREFERRED EMBODIMENT OF THE INVENTION

Figure 1:
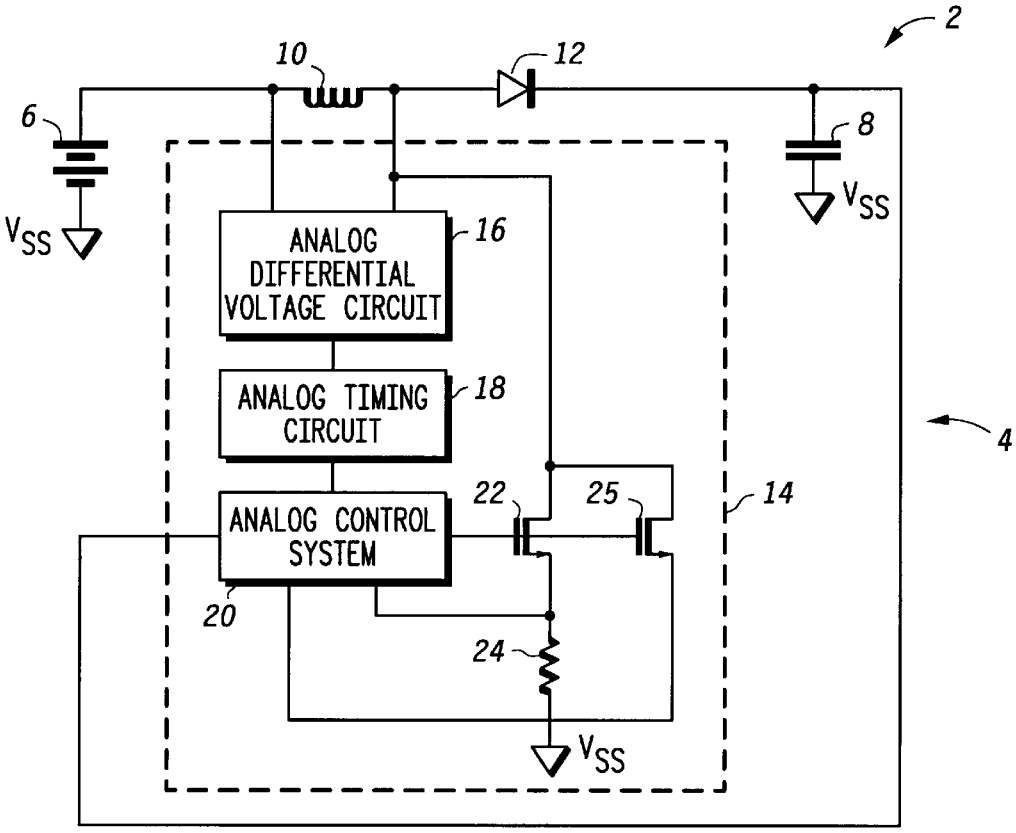
FIG. 1 depicts a block diagram for an analog open loop inductor current control system made in accordance with a preferred embodiment of the invention.

FIG. 1 depicts a block diagram of a preferred analog embodiment of open loop inductor current control system 2 made in accordance with a preferred embodiment of the invention. Open loop inductor current control system 2 is shown integrated with a boost-switching regulator circuit 4. Boost switching regulator circuit 4 is powered by battery 6. The reserve power source for boost switching regulator circuit 4 is provided by capacitor 8. Capacitor 8 is charged from current flowing through inductor 10. Diode 12 is provided between capacitor 8 and inductor 10 to prevent reverse flow of current from capacitor 8 back through inductor 10. Battery 6 provides power to integrated circuit 14. In the event that there is a reduction or complete loss in power from battery 6, capacitor 8 provides the reserve backup power source to the integrated circuit 14.

Boost switching regulator circuit 4 uses inductor 10 as a current source for charging capacitor 8. Through regulating the flow of current through inductor 10, the charge stored in capacitor 8 is optimally maintained. Note that inductor 10, diode 12, and capacitor 8 are not a part of integrated circuit 14. The dashed lines denote the boundary of integrated circuit 14.

An analog differential voltage circuit 16 measures the voltage drop across inductor 10. The output of analog differential voltage circuit 16 is a voltage value that is fed into an analog timing circuit 18. Based upon the value of the voltage difference measured by analog differential voltage circuit 16, analog timing circuit 18 marks off a period of time necessary for the level of current in inductor 10 to decrease from an upper boundary level to a lower boundary level. When analog timing circuit 18 has marked the period of time necessary for the current to drop from the upper boundary level to the lower boundary level, the analog circuit 18 provides an output to analog control system 20.

Boost transistors 22 and 25 regulates the addition of energy to inductor 10. Analog control system 20 controls the switching of boost transistors 22 and 25. In a preferred embodiment, transistors 22 and 25 is an NMOS transistor. However, other transistors known to the art may also be used instead of an NMOS transistor.

Energy is added to inductor 10 when the boost transistors 22 and 25 is turned ON. When the boost transistor is turned ON, current in inductor 10 increases linearly. The energy in inductor 10 is redirected to reserve capacitor 8 through diode 12 when boost transistors 22 and 25 is turned OFF. When boost transistors 22 and 25 is turned OFF, the current in inductor 10 decreases linearly.

The reserve voltage stored in capacitor 8 is fed back into analog control system 20. Analog control system 20 serves as a gate to the voltage boosting action provided by capacitor 8. Once capacitor 8 has acquired a desired level of charge, the boosting circuit 4 is shut down. However, when the voltage stored in capacitor 8 drops below a particular voltage value, the control circuitry restarts the boosting action to recharge capacitor 8.

When boost transistors 22 and 25 is ON, the current in inductor 10 is directed through integrated circuit 14. Analog control system 14 directly measures this flow of current through taking a voltage measurement across resistor 24. A Sense FET 25 bypasses most of the current around resistor 24 to reduce power consumption.

When boost transistors 22 and 25 is OFF, the analog differential voltage circuit 16 measures the voltage drop across inductor 10. This voltage measurement is fed to analog timing circuit 18. Analog timing circuit 18 determines the amount of time it will take the current in inductor 10 to drop from an upper boundary level to a lower boundary level.

The current within inductor 10 is maintained between the upper and lower boundary levels by the operation of the boost transistors 22 and 25 controlled by analog control system 20. When analog control system 20 determines that the voltage stored in capacitor 8 has dropped below a desired level, it turns boost transistors 22 and 25 ON. Turning boost transistors 22 and 25 ON adds energy to inductor 10 causing current to flow through inductor 10. This current flowing through inductor 10 flows into boost transistors 22 and 25. Analog control system 20 measures this current directly across resistor 24. When the boost transistors 22 and 25 is turned ON, current in inductor 10 increases linearly. When the level of current in inductor 10 reaches the upper boundary level, analog control system 20 turns boost transistors 22 and 25 OFF.

When boost transistors 22 and 25 is in an OFF state, the energy in inductor 10 is redirected toward capacitor 8 where it adds charge to capacitor 8. During the period while the transistor is OFF, no current is flowing from inductor 10 into integrated circuit 14. Therefore, it is not possible to use resistor 24 to measure the amount of current in inductor 10 directly.

When the boost transistors 22 and 25 is turned OFF, the current in inductor 10 decreases linearly. The analog control system 20 determines when to turn boost transistors 22 and 25 back ON by determining the period of time it will take the current in inductor 10 to linearly decrease from the upper boundary level to the lower boundary level. When this period of time to decrease from the upper to lower boundary level has expired, analog control system 20 turns boost transistors 22 and 25 back ON.

Open loop inductor current control system 2 determines the period of the OFF state for boost transistors 22 and 25 without actually measuring the current flowing through inductor 10. Open loop inductor current control system 2 is able to determine the period of boost transistors 22 and 25 OFF state without directly measuring the current through replicating the flow of current in inductor 10 externally.

Analog timing circuit 18 replicates the flow of current in inductor 10 externally. In a preferred embodiment, analog timing circuit is implemented with a current source, a capacitor, and a comparator. The basic equation for analog timing circuit 18 is given by equation (1) below:

$$I=C*dV/dt \qquad \text{Equation (1):}$$

Where I is the input current to the timing circuit 18, C is the capacitor integrated in the timing circuit, and dV is an arbitrary comparator trip point. Equation (1) that represents the operation of timing circuit 18 is used to simulate the performance of inductor 10. Equation (1) can be rewritten giving equation (2):

$$dt=C*dV/I \qquad \text{Equation (2):}$$

Equation (3) gives the general equation for inductor 10:

$$V=L*dI/dt \qquad \text{Equation (3):}$$

Equation (3) can be rewritten as equation (4):

$$dt=L*dI/V \qquad \text{Equation (4):}$$

Where V is the voltage across the inductor coil 10, L is the value of the inductance of inductor 10, and dI is the preset desired amount of change in the current. Setting equations (2) and (4) equal to each other yields equation (5):

$$C*dV/I=L*dI/V \qquad \text{Equation (5):}$$

In equation (5) both C and L are known device parameters. Both dV and dI are preset values. V is the measured voltage difference across inductor 10. Therefore, we have one equation and one unknown, the current I in timing circuit 18.

Solving equation (5) for the current I in timing circuit 18 reduces equation (1) to one unknown, the period of time dt. The period of time dt is the amount of time it takes the current in inductor change an amount dI. In open loop inductor current control system 2, dI is set to equal the difference between the amount of current at the upper current boundary and the amount of current at the lower current boundary. Therefore, dt in the timing circuit represents the amount of time it takes the current in inductor 10 to decay from the upper current boundary to the lower current boundary. Therefore, timing circuit 18 replicates the operation of inductor 10 externally. Timing circuit 18 enables open loop inductor current control system 2 to control the flow of current in inductor 10 without actually measuring the amount of current flow in inductor 10.

When the level of current in inductor 10 reaches the upper current boundary, analog control system 20 shuts boost transistors 22 and 25 off. Analog differential voltage circuit 16 measures the voltage difference V across inductor 10. This voltage difference V is fed into analog timing circuit 18. As described above, using equation (5), analog timing circuit 18 simulates the rate of current change in inductor 10. With the measured value of voltage V across inductor 10, timing circuit 18 marks the period of time dt that is needed for the current in inductor 10 to reduce from the upper current boundary to the lower current boundary. Once this period of time dt is marked, the comparator is tripped and sends an output to analog control system 20. When analog control system 20 receives this output from the comparator it turns boost transistors 22 and 25 back ON.

With boost transistors 22 and 25 back ON, the cycle of maintaining the current in inductor 10 begins again. With boost transistors 22 and 25 back ON, the current in inductor 10 increases linearly. When the current rises to the level of the upper current boundary, analog control system 20 turns boost transistors 22 and 25 OFF and begins timing circuit 18 to mark the period of OFF time for boost transistors 22 and 25.

Figure 2:
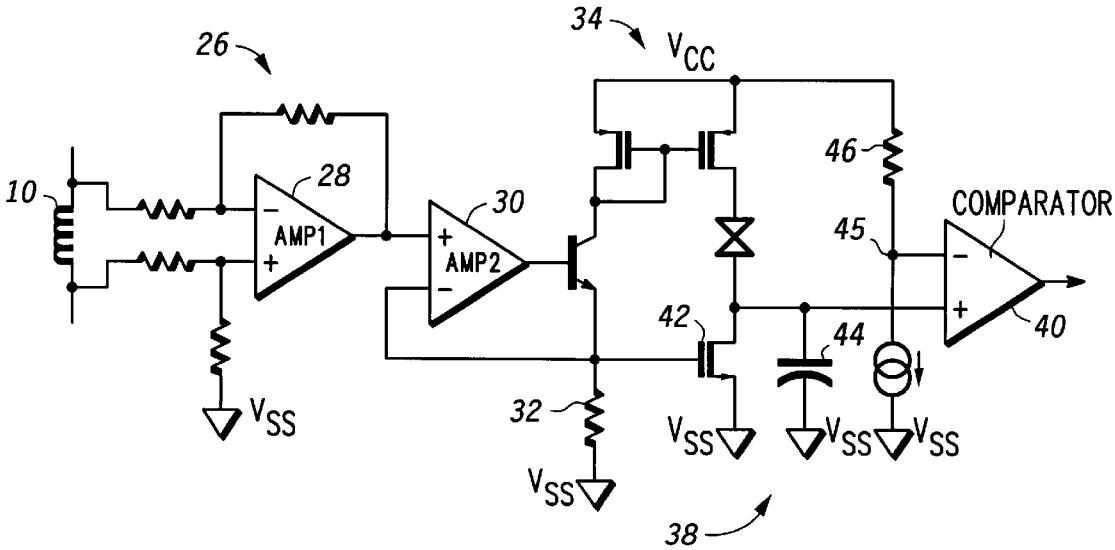
FIG. 2 depicts a circuit diagram for an analog control system made in accordance with a preferred embodiment of the invention.

FIG. 2 depicts a circuit diagram 26 for an analog control system made in accordance with a preferred embodiment of the invention. A first amplifier 28 is configured as a differential amplifier and measures the voltage difference across inductor 10. The output signal from first amplifier 28 is fed into a second amplifier 30. The second amplifier 30 is configured as a voltage follower and reproduces the output signal of first amplifier 28 over resistor 32 to create a proportional current signal. A current source 34 feeds the current signal produced over resistor 32 into an analog timer 38. A comparator 40 determines whether analog timer 38 has reached a trip point and provides an output based on whether analog timer 38 has reached the trip point.

Analog timer 38 is comprised of an NMOS transistor 42 and a capacitor 44.

NMOS transistor 42 resets the voltage of capacitor 44 to zero for every cycle between the high and low current levels of inductor. Capacitor 44 is charged with current provided by current source 34.

Comparator 40 determines whether capacitor 44 has reached a level of voltage indicating that a full cycle between high and low inductor current levels has occurred. Comparator 40 compares the voltage stored within capacitor 44 to the voltage $Vcc-R2*I_{0TC}$ generated by the trip point circuit 45. $I_{0TC}$ is a zero temperature coefficient current generated elsewhere in integrated circuit 14. Temperature has a significant effect on resistor components in an integrated circuit. However, it is possible to compensate for this temperature variation through using various circuit design techniques. These temperature compensation techniques enable the present invention to function in automobile applications where the temperature varies widely. In the present circuit, temperature will vary the resistance of resistor R2 46. However, through using the zero temperature coefficient current in combination with R2 46, it is possible to compensate for the resistor 32 temperature variance and ensure that it remains proportional to the remainder of the system 2. Comparator 40 provides its output to control system 20.

In FIG. 2, analog timing circuit 18 is shown to be a current timing circuit. However, it is also possible to use a voltage timing circuit well known to the art to accomplish the same task of marking the time period dt required for the current in inductor 10 to fall from the upper current boundary to the lower current boundary.

Figure 3:
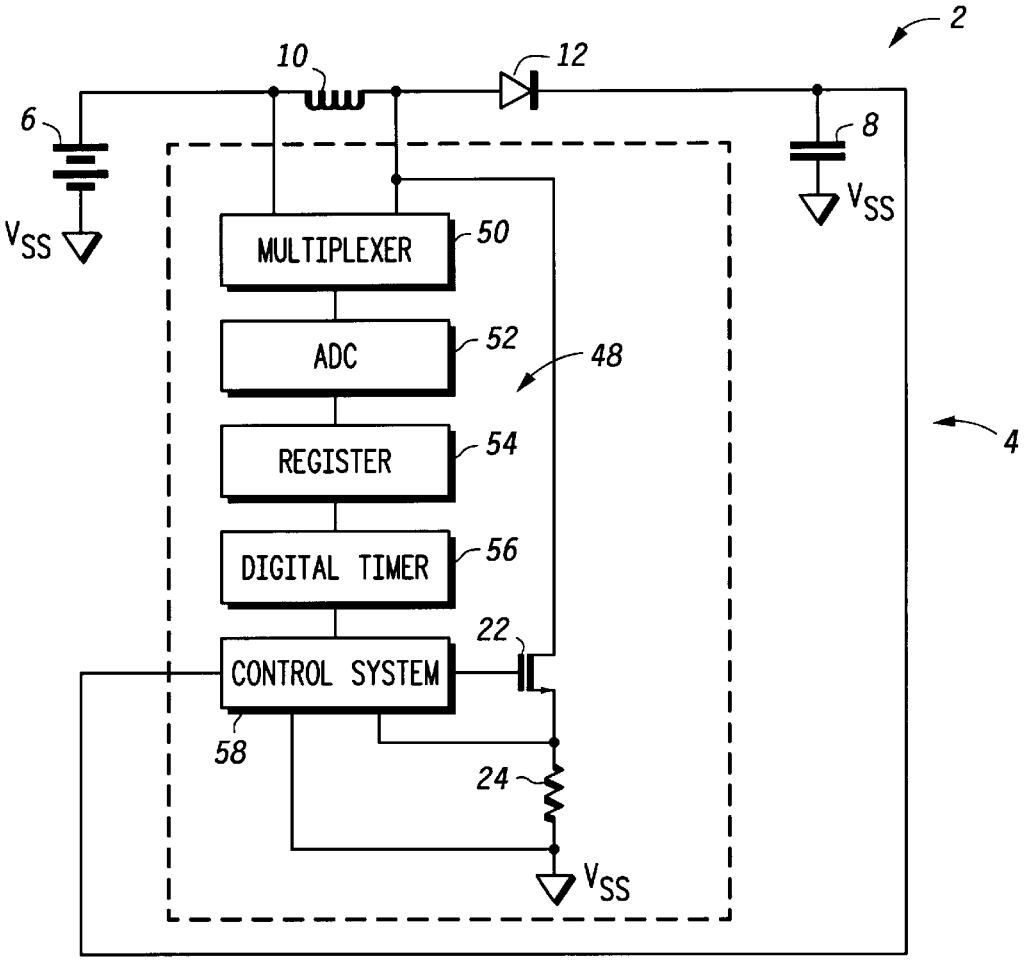
FIG. 3 depicts a block diagram for a digital open loop inductor current control system made in accordance with a preferred embodiment of the invention.

FIG. 3 depicts a block diagram for a digital open loop inductor current control system 48 made in accordance with a preferred embodiment of the invention. A multiplexer 50 measures the voltages at each end of inductor 10. These voltages are passed to an Analog to Digital Converter (ADC) 52. Both of the measured voltages are converted to digital values by ADC 52 where they are then stored in a register 54. Storing the two voltage values in register 54 enables the digital system 48 to perform mathematical operations on the values. The system 48 subtracts the two voltage values to determine the voltage drop across inductor 10. The result of this subtraction is sent to a programmable digital timer 56. Programmable digital timer 56 performs the identical operation of analog timing circuit 18. Programmable digital timer 56 marks the period of time it takes for the current in inductor 10 to reduce from the upper current boundary to the lower current boundary. At the end of this time period, programmable digital timer 56 sends a signal to digital control system 58 that then triggers boost transistors 22 and 25 to turn ON.

Figure 4:
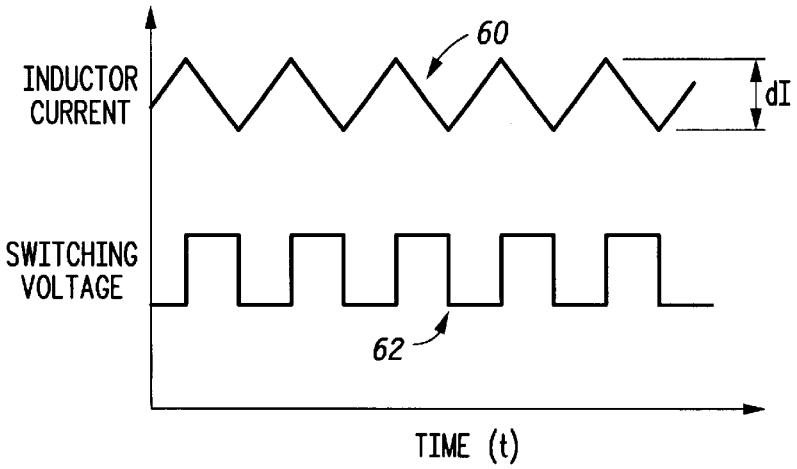
FIG. 4 depicts the time varying current and voltage signals in and across an inductor regulated in accordance with a preferred embodiment of the invention.

FIG. 4 depicts the time varying current and voltage signals in and across an inductor regulated in accordance with a preferred embodiment of the invention. The top signal 60 is the inductor current. The bottom signal 62 is the switching voltage. The switching voltage is switched from a high voltage to a low voltage by boost transistors 22 and 25. When boost transistors 22 and 25 is turned ON, the switching voltage falls to the low value and the inductor current increases linearly. When boost transistors 22 and 25 is turned OFF, switching voltage 62 increases to the high value and the inductor current 60 linearly decreases. As is seen in FIG. 4, the open loop current control system 2 keeps the inductor current 60 within a bounded region dI.

Figure 5:
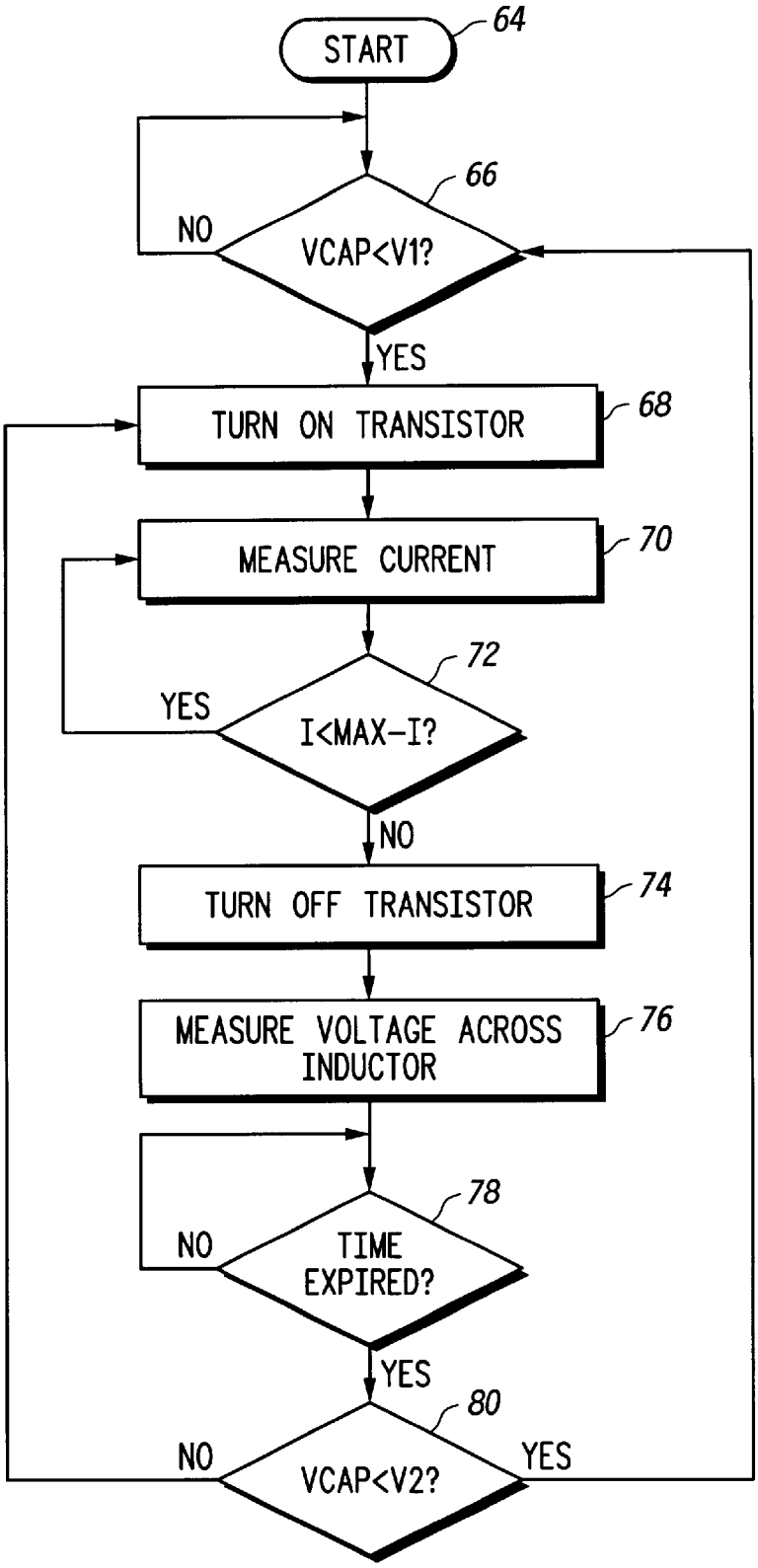
FIG. 5 depicts a flow chart of a preferred operation for an open loop inductor current control system made in accordance with a preferred embodiment of the invention.

FIG. 5 depicts a flow chart of a preferred operation for an open loop inductor current control system made in accordance with a preferred embodiment of the invention.

The steps 68 through 78 outline the recharging process of capacitor 8. Steps 66 and 80 determine whether the system will begin or stop the recharging process. The process of controlling the current flow in inductor 10 begins at step 64. The process determines whether the voltage in capacitor 8 (Vcap) has fallen below a preset voltage level V1. If Vcap has not fallen below V1, then the system continues to monitor whether Vcap has fallen below V1. If Vcap has fallen below V1, the process flows to 68 where the system turns ON boost transistors 22 and 25. Integrated circuit 14 measures the flow of current in step 70. In step 72, the system determines if the level of current (I) in inductor 10 is still below the upper level of current (Max-I). If the level of current I remains below the Max-I, the system continues to measure the current. When the current I equals Max-I, transistors 22 and 25 is turned OFF in step 76. In step 78, the system determines if the timing circuit 18 has marked the full period of time required for the current in inductor 10 to decay from the upper boundary level to the lower boundary level. When that time has expired, the system determines in step 80 whether the voltage in capacitor 8 (Vcap) has risen above a preset voltage level V2. If it has, then the system returns to step 66 and monitors Vcap to begin the recharging process (steps 68 through 78) when Vcap decays below V1.

The process beginning with step 64 and proceeding through step 80 is stored in a preferred digital embodiment in a program storage device readable by a machine, such as a magnetic media, optical media, ROM, RAM, or other computer storage devices known to the art.

Although the present invention has been described in detail, it will be apparent to those of skill in the art that the invention may be embodied in a variety of specific forms and that various changes, substitutions, and alterations can be made without departing from the spirit and scope of the invention. The described embodiments are only illustrative and not restrictive and the scope of the invention is, therefore, indicated by the following claims.

We claim:

1. An open loop inductive element current control system for an inductor, comprising:

a switch connected to said inductive element;

a control system connected to said switch;

a current sensing circuit connected to said control system; said control system determines a duration of time said switch is in an ON mode from said current sensing circuit;

a timing circuit connected to said control system, said control system determines a duration of time said switch is in an OFF mode from said timing circuit; and a differential voltage circuit connected to said timing circuit.

2. The system of claim 1, wherein said switch is a transistor.

3. The system of claim 2, wherein said duration of time is a period of time a flow of current in said inductive element takes to decay from an upper current level to a lower current level.

4. The system of claim 3, wherein said timing circuit is comprised of an analog timing circuit.

5. The system of claim 3, wherein said timing circuit is comprised of a digital timing circuit.

6. The system of claim 4, wherein said differential circuit means is comprised of a differential amplifier.

7. The system of claim 5, wherein said differential voltage circuit is comprised of:

a multiplexor;

an analog to digital converter;

a register;

a digital system, said multiplexor measures a voltage value at each of said inductor, said analog to digital converter converts said voltage values into a digital signal, said register stores said digital signal, said digital system subtracts said voltage values.

8. An open loop inductor current control system, comprising:

switching means to regulate a flow of current in an inductive element;

control means to operate said switching means;

current sensing means to provide a current information to said control means when said switch is in an ON mode;

timing means to provide said control means a measured period of time that said switching means remains in an OFF mode; and differential voltage means to provide said timing means an information about a voltage difference across said inductive element.

9. The system of claim 8, wherein said switching means is comprised of a transistor.

10. The system of claim 8, wherein said measured period of time is a period of time said flow of current takes to decay from an upper current level to a lower current level.

11. The system of claim 8, wherein said timing means is comprised of an analog timing circuit.

12. The system of claim 8, wherein said timing means is comprised of a digital timing circuit.

13. The system of claim 8, wherein said differential voltage means is comprised of a differential amplifier.

14. The system of claim 8, wherein said differential voltage means is comprised of:

a multiplexor;

an analog to digital converter;

a register;

a digital system, said multiplexor measures a voltage value at each of said inductive element, said analog to digital converter converts said voltage values into a digital signal, said register stores said digital signal, said digital system subtracts said voltage values.

15. A method for regulating a current flow in an inductor, comprising the steps of:

turning a transistor ON when a capacitor voltage falls below a first preset voltage level;

measuring a flow of current in said inductor;

comparing said flow of current to a preset value of current flow;

turning OFF said transistor when said flow of current reaches said preset value of current flow;

measuring a voltage difference across said inductor;

counting a period of time based upon said voltage difference; and comparing said capacitor voltage to a second preset voltage level after said period of time expires.

16. The method of claim 15, further comprising the step of:

turning ON said transistor when said capacitor voltage level is less than said second preset voltage level.

17. The method of claim 15, further comprising the step of:

comparing said capacitor voltage to said first preset voltage level when said capacitor voltage level is greater than said second preset voltage level.

18. A program storage device readable by a machine, tangibly embodying a program of instructions executable by the machine to perform method steps regulating a current flow in an inductor, said method steps comprising;

turning a transistor on when a capacitor voltage falls below a first preset voltage level;

measuring a flow of current in said inductor;

comparing said flow of current to a preset value of current flow;

turning off said transistor when said flow of current reaches said preset value of current flow;

measuring a voltage difference across said inductor;

counting a period of time based upon said voltage difference; and comparing said capacitor voltage to a second preset voltage level after said period of time expires.

19. The method of claim 18, further comprising the step of:

turning on said transistor when said capacitor voltage level is less than said second preset voltage level.

20. The method of claim 18, further comprising the step of:

comparing said capacitor voltage to said first preset voltage level when said capacitor voltage level is greater than said second preset voltage level.

21. A method of regulating a flow of current in an inductor, comprising the steps of;

turning a transistor on to increase said flow of current in said inductor;

measuring said flow of current;

turning said transistor off to decrease said flow of current when said flow of current is greater than a preset upper value;

timing a period of time it takes said flow of current to decay from preset upper value to a preset lower value;

turning said transistor on when said period of time expires.

22. The method of claim 21, comprising the further step of measuring a voltage difference across said inductor.

* * * * *